US007503129B2

(12) United States Patent
Mann

(10) Patent No.: US 7,503,129 B2
(45) Date of Patent: Mar. 17, 2009

(54) STEAM BLOWER BOX

(75) Inventor: Rudolf Mann, Schwalbach am Taunus (DE)

(73) Assignee: V.I.B. Systems GmbH, Maintal (DE)

( * ) Notice: Subject to any disclaimer, the term of this patent is extended or adjusted under 35 U.S.C. 154(b) by 224 days.

(21) Appl. No.: 11/147,877

(22) Filed: Jun. 8, 2005

(65) Prior Publication Data

US 2005/0268482 A1 Dec. 8, 2005

(30) Foreign Application Priority Data

Jun. 8, 2004 (DE) ..... 10 2004 027 972

(51) Int. Cl.
*F26B 21/00* (2006.01)

(52) U.S. Cl. ..... 34/568; 34/444

(58) Field of Classification Search ..... 34/114, 34/115, 122, 124, 638, 444, 568, 636, 652
See application file for complete search history.

(56) References Cited

U.S. PATENT DOCUMENTS 4,358,900 A * 11/1982 Dove ..... 34/568
4,422,575 A 12/1983 Dove
4,622,762 A * 11/1986 Reed ..... 34/638

* cited by examiner

*Primary Examiner*—Kenneth B Rinehart
(74) *Attorney, Agent, or Firm*—Friedrich Kueffner

(57) ABSTRACT

A steam blower box for applying steam onto a material web, particularly paper, which travels past the steam blower box. The steam blower box has a front and a rear limitation as seen in the travel direction of the material web and a steam chamber located between the front and rear limitations, wherein the steam chamber is open toward the material web. The steam chamber is closed off at its front and rear ends in the direction of travel by a limiting surface each of which protrudes in the direction toward the material web, and particularly forms a limiting edge; between the limiting surfaces, the steam chamber has a housing wall which is recessed relative to the material web. For achieving an air-free steam chamber of the steam blower box, a first steam outlet opening is provided in the housing wall immediately adjacent to the front limiting surface.

4 Claims, 7 Drawing Sheets

STEAM BLOWER BOX

BACKGROUND OF THE INVENTION

1. Field of the Invention

The present invention relates to a steam blower box for applying steam onto a material web, particularly paper, which travels past the steam blower box. The steam blower box has a front and a rear limitation as seen in the travel direction of the material web and a steam chamber located between the front and rear limitations, wherein the steam chamber is open toward the material web. The steam chamber is closed off at its front and rear ends in the direction of travel by a limiting surface each which protrudes in the direction toward the material web, and particularly forms a limiting edge; between the limiting surfaces, the steam chamber has a housing wall which is recessed relative to the material web. The invention further relates to a corresponding method for controlling the steam quantity and/or steam outlet speed from the steam outlet openings of a steam blower box.

2. Description of the Related Art

In certain process steps during the manufacture and further processing of paper, steam is supplied to a moving material or paper web. For this purpose, steam is usually blown in the towards the material web from a steam blower box which is arranged in the vicinity of the web but does not contact the web. For blowing the steam, the steam blower box has, on a side facing the web, steam outlet openings to which controllable quantities of steam are supplied in a suitable manner. The steam emerging from the steam blower box is supposed to impinge upon the material web, to condense on the material web and transfer the condensation heat to the material web. The condensate is simultaneously deposited on or in the material web and thereby produces an increase in moisture. Because of the movement of the material web, the condensate is continuously transported away from the steam application zone, so that no condensate layers can be formed which could significantly impair the further condensation because of its thickness.

However, because of friction at its surface, the moving material web produces an air flow which in the area near the web is taken along and conveyed into the steam application zone or steam chamber. The air in the steam application zone between the steam outlet openings of the steam blower box and the material web leads to difficulties in several respects.

First, the air present in the steam application zone comes into contact with the emerging steam, so that in the border area with the steam, the air is heated to 100° C. and is saturated with moisture. When cooling takes place later the air is oversaturated with moisture and discharges water droplets. This results in visible steam clouds which reduce the quality of the ambient area in the work area and lead to the formation of drops at the machine components. In addition, the energy utilized for heating the air is essentially lost for heating the web and the efficiency of the plant is reduced.

A second, significantly more important disadvantage of the presence of air in the steam application zone is that the heat transfer to the material web is reduced. While air molecules heated to 100° C. are cooling themselves when they transfer heat to the colder material web, so that the heat transfer drops immediately, the steam molecules transfer the entire condensation energy at the temperature level of 100° to the material web. This is the explanation for the known fact that the heat transfer as a result of condensation is significantly poorer when inert gases are present than in a steam application zone which is entirely filled with steam.

For displacing the air from the web surface and to produce a direct contact of the steam with the material web, so called high-speed steam blower boxes have been known in the art for some time, wherein steam jets which impinge with a sufficiently high speed on the material web destroy the air layer in the area near the surface of the material web and thereby produce a direct contact between steam and web molecules. However, this does not at all displace the air from the steam application area. The occurring negative pressure in the area of the steam outlet openings of the steam blower box is due to an injection effect, any air which has reached the steam application area is sucked up by the steam jets and is blown together with the steam toward the material web. Accordingly, in these known high-speed steam blower boxes, inert gas is also present in the steam application zone.

A device for applying steam onto a material web of the above-described type is known, for example, from DE 37 01 406 A1. In this device, a steam application chamber is to be sealed off by means of steam locks. The steam locks are produced by blower openings which are provided in the entry zone and the exit zone, wherein the blower openings are inclined toward the principal zone of the blower openings and through which the steam jets blow out. This steam lock also does not make it possible to reliably prevent the entry of air into the steam application chamber; this is because air is taken in because of the injector effect at the outlet openings of the steam jets. The presence of air is even described as being an advantage. It is also not sufficient, as partially known in the art, to align the steam jets obliquely against the travel direction of the web. As long as air is sucked up at the steam outlet openings, this air is conveyed into the up at the steam outlet openings, this air is conveyed into the steam application are and decreases the efficiency of the steam application.

In addition, a device for sealing a steam blower box is known from DE 297 03 627 U1. In this device, the blower chamber is to be sealed off by a double slot nozzle, wherein steam flows out of the slot-shaped nozzle facing the lower chamber and air flows out of the nozzle facing away from the lower chamber. When they impinge upon the material web, these two flows are supposed to separate in such a way that the air flow is conducted against the travel direction to a discharge means and the steam reaches the lower chamber. Aside from the fact that this device requires a high-pressure steam nozzle and a high-pressure air nozzle, a separation of steam and air cannot be achieved when additional air is discharged. The more air is blowing out of the high-pressure air nozzle, the higher the backed-up pressure of the jet impinging upon the material web will be. However, the relation between the pressure in the air area and the pressure in the steam are in the vicinity of the web is the deciding factor whether air enters the steam are or steam is discharged. This makes it clear that an additional air flow is counterproductive for keeping air out of the steam application zone or the steam chamber.

SUMMARY OF THE INVENTION

It is the primary object of the present invention to propose a steam blower box of the above-described type in which the air is completely kept out of the steam chamber or the steam application area between the steam outlet openings and the moved material web, so that a high efficiency of the steam blower box is achieved.

In accordance with the present invention, a first steam outlet opening is provided in the housing wall immediately adjacent to the front limiting surface.

As a result of this geometric configuration of the steam blower box, the intake of air is prevented, wherein simultaneously a steam flow is directed against the material web at the front limiting surface of the steam chamber or the steam application area. This combination of features is capable of preventing air from entering the steam application area. Accordingly, the first steam outlet opening is arranged in accordance with the present invention at a greater distance from the material web than the limiting edges of the steam chamber or steam application area formed by the limiting surfaces, wherein the edges are moved toward the material web as closely as safety of the material web permits with respect to contact of the moving material web. Since the first steam outlet opening is arranged immediately adjacent to the front limiting surface, i.e., is placed against the direction of movement of the web as closely as possible to the limiting edge where the increase of the distance of the steam chamber from the web begins, it is made possible that the air arriving with the material web no longer has access to the negative pressure area which is being formed at or behind the first steam outlet opening in the steam application area. The steam flows instead along this front limiting surface and is aligned relative to the material web in such a way that a displacement takes place out of the area of the steam chamber or the steam application zone itself where a sufficient degree filling with steam can be ensured. On the other hand, the arriving air is deflected.

Since, because of the negative pressure area formed in the steam chamber, air also flows in at the rear limitation from the end of the steam blower box on the side of the web exit, it is possible in accordance with the present invention to form a second steam outlet opening in the housing wall immediately adjacent to the rear limiting surface of the steam chamber, so that, consequently, the limiting surface is located immediately in front of the rear limiting edge in the direction of travel of the material web. This configuration also effectively prevents the entry of air into the steam application chamber by utilizing the same operating principle as used at the front limiting edge.

In contrast to the prior art, the arrangement according to the present invention prevents the entry of additional air in the border area between the surroundings and the steam chamber or the steam application zone. On the other hand, the air entrained by the material web can be displaced from the web by the steam jets and can be conveyed away by having the steam jets guided along the limiting surfaces convey the air present at the web entry side of the steam blower box against the direction of movement of the material web and force the air out of the steam blower box. This is achieved because, due to the configuration in front of the front limiting edge according to the present invention, the steam jet from the first steam outlet opening facilitates a higher back-up pressure of the air entrained by the material web than would be present at the outer side of the front limitation of the steam blower box. A similar manner of operation takes place also at the end of the steam blower box on the side of the web exit.

In accordance with the present invention, this effect can be further increased by outwardly inclining the front and/or rear limiting surfaces relative to the housing wall of the steam chamber by an angle of 90° to 120°, preferably about 95° to 100°. As a result, the limiting surfaces extending transversely of the web direction are inclined relative to the direction of movement of the material web; thus, the limiting surface at the side of the web entry is inclined against the travel direction of the web and the limiting surface at the web exit side is inclined in the direction of travel of the web.

In accordance with a preferred feature, a front sealing zone is provided between the front limitation of the steam blower box and the front limiting surface or edge of the steam chamber, in order to achieve a particularly good locking effect.

In particular, the front sealing zone can be constructed in accordance with the present invention in such a way that an air vortex is formed in the sealing zone on the side of the web entry; on the side facing the material web, the air vortex extends against the direction of movement of the material web and on the side facing the steam blower box, the air vortex extends on the side of the steam blower box in the direction of movement of the material web. Such an air vortex, which is always newly started in the sealing zone by the suction effect along the limiting edge, the air entrained by the material web can be transported particularly effectively against the direction of movement of the material web. The front sealing zone should preferably be as short as possible particularly in the direction along the material web, so that the beginning of the steam application zone in the steam chamber is located as closely as possible at the front limitation of the steam blower box on the entry side of the web, so that the return travel path for the air already in the area between the steam blower box and the material web is minimized.

In accordance with the present invention, it is also possible to provide a rear sealing zone between the rear limitation of the steam blower box and the rear limiting surface or edge of the steam chamber. In this connection, the rear sealing zone is preferably constructed in such a way that an air vortex is formed on the web exit side in the sealing zone. On the side facing the material web, the air vortex extends in the travel direction of the material web, and on the side facing the steam blower box, the air vortex extends against the direction of travel of the material web, so that an effective air lock is also obtained at the end of the steam blower box at the web exit side.

A particularly good sealing effect is achieved if the sealing zones have sections with a gap with a distance between the steam blower box and material web which is smaller than the distance between the steam blower box and the material web in the steam chamber. In order to encourage the formation of air vortices in spite of the small cap width in the sealing zone, according to the present invention drops may be formed in the front and/or rear sealing zones. For further influencing the flow conditions, a suction duct (suction) may be provided in the front and/or rear sealing zones, and/or an inlet opening (blow-in) particularly for air may be provided. As a result, the flow conditions of steam and/or air can be simply adjusted in such a way that an optimum sealing effect is achieved.

In accordance with a preferred embodiment of the present invention, a third steam outlet opening can be arranged in the steam chamber between the first steam outlet opening and the second steam outlet opening, wherein steam is supplied separately to the first, second, and third steam outlet openings. The third steam outlet opening particularly makes it possible to precisely adjust a high steam requirement. In accordance with the invention, the first, second, and/or third steam outlet opening can each consist of a group of several steam outlet openings which are arranged one behind the other and/or next to one another, and which are combined in a first, second, and/or third group for controlling the outlet openings. The first group is arranged immediately adjacent to the front limiting surface of the steam chamber and the second group is arranged immediately adjacent to the rear limiting surface of the steam chamber. The steam outlet openings of the third group are distributed in the remaining steam chamber or steam application are in accordance with the remaining heat absorption capacity of the material to be expected.

In order to achieve different steam application intensities transversely of the direction of movement of the material web, the steam outlet openings or the groups of steam outlet openings can be controllable separately in zones transversely of the direction of movement. In dependence on the respective method step, the resulting temperature increase and/or moisture increase can be adapted to the requirements of the manufacturing process to different extents transversely of the direction of movement of the web, in order to be able to prevent or remove irregularities which occurred in prior process stages.

For adjusting the steam quantity and/or steam outlet speed from the various steam outlet openings, the present invention provides a control which makes it possible to seal especially the steam chamber reliably against the penetration of air.

For this purpose, one or more temperature sensors may be arranged in the steam blower box, wherein the sensors interact with the control. Based on the temperature distribution in the steam blower box, the control fo the steam quantity and/or steam outlet speed from the various steam outlet openings can be adjusted in such a way that a reliable sealing effect of the steam chamber is achieved. In accordance with the invention, preferably several temperature sensors are arranged in different temperature zones.

In accordance with a preferred feature, the control can operate in accordance with a method for controlling the quantity of steam and/or the steam outlet speed from the steam outlet openings of a steam blower box by applying steam onto a material web which travels past the steam blower box, wherein an air vortex is formed when sealing the steam chamber against air in a front sealing zone provided between the front limitation of the steam blower box and the steam chamber. For this purpose, the invention provides that the steam quantity and/or steam outlet speed from especially the first steam outlet opening or group of steam outlet openings is increased until a temperature is measured in the area of the air vortex which is preferably approximately equal to the steam temperature. This temperature usually will be somewhat below the steam temperature but significantly above the ambient air temperature. In that case, it can be assumed that an air vortex has formed in the sealing zone and the air has been successfully locked off relative to the steam application area.

In accordance with an advantageous further development of the method according to the present invention, the temperature can be measured additionally in the area of the front limitation, wherein the steam outlet quantity and/or steam outlet speed are selected in such a way that the temperature corresponds in the are of the front limitation approximately to the temperature of the ambient air. This is the case when, as desired, essentially no steam escapes from the steam blower box.

In order to be able to make an optimum adjustment, the control of the present invention can withdraw air from between the front limitation and the air vortex, in order to facilitate the withdrawal of excess steam which is necessary particularly at higher web speeds. For controlling the adjustments, the adjustments of the temperature of the suction duct can also be measured.

In accordance with the invention, it is also possible to form an air vortex in a rear sealing zone provided between the rear limitation of the steam blower box and the steam chamber, wherein the rear sealing zone has a purpose of sealing the steam chamber relative to the air. Air may be withdrawn between the air vortex and the rear limitation, in order to achieve an effective sealing effect relative to the end of the side of the web exit. By adjusting the withdrawal intensity and the steam quantity and/or steam outlet speed from especially the second steam outlet opening, a temperature which is as high as possible can be achieved in the air vortex and the withdrawal can be adjusted so that heating relative to the ambient air is as small as possible in order to achieve a good sealing effect.

From the temperature values measured by the individual sensors it is possible to draw conclusions with respect to the steam application and flow conditions within the steam application area and to readjust the control accordingly. Consequently, this also makes it possible to establish an automatic control.

Before discussing a specific embodiment of the steam blower box according to the present invention in detail with the aid of the drawing, first the basics of the pressure distribution and the heat transfer in the area between the steam blower box and the material web will be described generally and the significant advantages of the present invention will be emphasized.

It will be explained how the air supply between the material web and the steam blower box at the ends on the web entry side and on the web exit side is to be blocked relative to the steam chamber including the steam application area. The limitations of the steam blower box are placed as closely as possible toward the web, however, they are not supposed to contact the web.

The principle of locking is based on the fact that the steam jets impinging upon the material web in the border area between steam and air develop a higher pressure than the air pressure which is present at the corresponding location or is generated during operation. This pressure generation requires a special explanation because it depends upon several influence values.

A moving material web takes along with it in its closest vicinity an air flow because of frictional forces, wherein directly at the web the air flow has the speed and direction of the web, and becomes slower with increasing distance from the web. If an obstacle is placed into this air flow near the web, wherein the steam blower box arranged close to the web constitutes such an obstacle, the air flow backs up. An excess pressure is generated at the front edge of the obstacle and a corresponding negative pressure is generated at the web exit side, as schematically illustrated in FIG. 5*a*. However, this pressure generation does not significantly reduce the quantity of the air which flows through the gap between the material web and the obstacle, i.e., the air flowing into the steam application area in the case of a steam blower box, is not significantly reduced because the negative pressure area following the back-up area once again accelerates the initially decelerated air flow and sucks the air into the gap between the obstacle and the material web. The same occurs in the case of several obstacles which are arranged one behind the other in the direction of the web travel, as illustrated, for example, in FIG. 5*b*. If the steam blower box has a contour with several successively arranged small and large gap widths relative to the material web, the back-up pressure increases at each new width restriction above the value of the previous restriction, however, the pressure drop is much greater at the web exit because a corresponding negative pressure is produced at this location. Accordingly, also in this case, the air quantity flowing through the gap between the steam blower box and the material web will be approximately equal. The present invention is based on these findings. In order to be able to completely stop the air flow entrained by the web completely by means of the discharged steam, the steam jets must produce an excess pressure when impinging upon the material web, wherein this excess pressure is greater than the back-up pressure of the air flow. This required pressure is lowered to the extent that the stopped air flow can develop less resistance.

When converting this finding into practice, the beginning of the steam chamber or steam application area or zone is in the steam blower box according to the present invention as closely as possible at the front limitation on the web entry side of the steam blower box, so that the air entering with the moving material web in the gap between the material web and the steam blower box does not have to be conveyed out by a large distance against the travel direction of the material web. Consequently, a sealing zone provided between the outer limitation of the steam blower box and the beginning of the steam chamber is to be kept as short as possible. Moreover, the front limitation of the steam blower box may have a greater distance from the web than the limiting edge of the steam application area on the side of the web entry, so that the returned air can exit more easily. An additional means can optionally be provided between the front limitation of the steam blower box and the limiting edge of the steam chamber, so that the desired flow conditions can be improved.

At the end of the steam chamber on the side of the web exit, the present invention should ensure that the pressure of the steam jets impinging upon the material web is greater than the air pressure because, when the air supply is successfully locked at the front end of the steam chamber, a negative pressure is produced at the rear end of the steam chamber, wherein the negative pressure produces an air flow from the limitation of the steam blower box on the side of the web exit against the web movement into the steam chamber. This air flow is held back by the locking flow of steam according to the present invention at the rear limiting surface of the steam chamber and is deflected into the direction of the web. In the area near the web, this air once again flows back out together with the web. When this return flow impinges upon the web, a slight excess pressure is also produced, so that the steam pressure must be higher at the limiting edge of the steam chamber on the side of the web exit. If that were not the case, air would flow into the steam chamber from the web exit side of the steam blower box. Also in this case, the flow conditions can be influenced by an additional suction means if air is suctioned off between the limitation of the steam blower box on the side of the web exit and the rear limiting edge of the steam chamber on the side of the web exit. This reduces the return flow directed against the web, so that the required steam impingement pressure at the rear limitation of the steam chamber becomes smaller.

For understanding the flow conditions, it is further necessary to take a look at the pressure distribution in the steam chamber itself which builds up between the steam blower box and the moving material web, wherein this pressure distribution depends decisively upon the heat absorption capability of the material web.

If the steam can discharge its condensation heat when impinging upon the material web, the steam will condense and lose a major portion of its volume. Under these conditions, a negative pressure is generated in the vicinity of the web which leads to gas in the form of air or steam to be suctioned away from the surroundings. Accordingly, an excess pressure can only be built up at the material web at the limitations of the steam chamber when more steam impinges upon the web than can be condensed at this location.

If it is assumed that the steam chamber is free of air, that quantity of heat is transferred to the material web which is discharged as a result of the movement of the material web or within the web by heat conduction. The heat conduction is proportional to the respective temperature drop and, therefore, continuously decreases with increasing heating of the material web when traveling through the steam application area. In addition, any web components already heated by the movement of the material web are continuously further transported which in the later process leads to an also reduced heat absorption capability. The computational pattern of the heat transfer from a chamber completely filled with steam to a material web traveling by having an initial temperature of less than 100° C., can be described approximately by a potential function in the form of $$Q=a\cdot x^{-b}$$

wherein x is the coordinate in the web direction with the value 0 at the border between air and steam on the side of the web entry.

In order to be complete, it shall be mentioned that the values a and b of the above equation are not constants but themselves depend on the coordinate x to the degree as the heat flux has arrived on the rear side of the material web which faces away from the steam application area. The following process-specific parameters determine the value of the constants: initial temperature of the web, web speed, heat conducting capability and specific heat capacity of the material web (both strongly dependent upon their moisture content), thickness of the material web, and the efficiency in the border area with the air if still present.

At the beginning of heating of the web in the steam application area (x=0), the equation represents a sudden temperature increase from an air-filled chamber (x<0) to a steam-filled chamber (x>0). However, in actual practice, the air in the border area is already preheated by the contact with steam, so that the air, in turn, can transfer some heat to the material web. Consequently, the above equation does not apply in this border area and the unrealistic beginning of the heat transfer with infinitely large values can be replaced by assuming a linear temperature rise in the area of heated air. Nevertheless, it must be expected in principle that a maximum of heat transfer and, thus, steam condensation will occur at the border of the steam-filled chamber at the limitation on the web entry side (beginning of the steam chamber). During further steam application, the heat transfer and, thus, the steam consumption decrease in accordance with the potential function. Depending on the given parameters, i.e., web properties, web temperature, web speed, the steam requirement of the first approximately 20 mm in the steam chamber can be between 60% and 99% of the overall steam requirement, assuming an efficiency of the heat transfer of 100%.

On the other hand, the heat absorption capacity of the material web becomes zero towards the end of the steam chamber. Nevertheless, a sufficiently high pressure of the impinging steam jets onto the web must be produced at this end in order to prevent the above-described rearward air flow against the web travel and to seal the steam chamber relative to inflowing air. Therefore, at the limitations of the steam chamber on the sides of the web entry and the web exit, a greater steam quantity must be applied than at the corresponding impingement locations of the web. Accordingly, in accordance with the invention, it is necessary to operate with a certain steam excess relative to the quantity which corresponds to the heat absorption capacity of the material web, so that a completely steam-filled steam chamber can be achieved. In order to keep the excess as small as possible, a negative pressure is tolerated in the interior of the steam application area.

In the practical application of the invention, this means that primarily the first steam exit opening at the front limiting surface must be supplied with sufficient steam. In order to achieve a sealing action also at the rear end of the steam chamber, sufficient steam should be supplied also to a second steam outlet opening immediately in front of the rear limiting surface. The first and second steam outlet openings may be a first or second group of several steam outlet openings. Another third group of steam outlet openings may optionally be provided between the two groups, wherein the discharged steam quantity of the third group is supposed to support the border pressures.

As the steam condenses to the extent that the web is still capable of absorbing heat, pressure differences and corresponding flow patterns occur within the interior of the steam chamber which compensate for the uncertainties of the precalculation of the heat absorption capacity of the web caused by the plurality of influence values. Still, in accordance with the present invention, the steam outlet openings of the third group can be distributed in the direction of the web approximately analogous to the previously mentioned heat transfer function (potential function). As a result, particularly in the case of steam blower boxes which are large in web direction, pressure differences within the steam application area which are too large are prevented; these pressure differences could result in an air flow from the lateral limiting edges. In the following, it will be described how the discharged steam jets and the optionally provided suction means can be adjusted in such a way that the desired effect can be achieved. In this regard, it is necessary to once again consider the border areas between steam and air. When the steam jets from the steam outlet openings of the first group flow along the limiting surface in the direction of the material web and come into contact with air at the end of the limiting surface, they have, in accordance with the invention, relative to the air a very high speed because they could otherwise not produce the necessary back-up pressure on the material web. This creates an injector effect at the outer side of the front limiting edge of the steam chamber, i.e., air is sucked in.

Basically this contact between air and steam is undesirable because, on the one hand, heat is transferred to the air and, on the other hand, the acceleration of the air in the direction of the material web contributes to a pressure increase on the air side. However, this is unavoidable. However, the quantity of air which is sucked in can be kept small as a result of the configuration of the limiting edge between the air area and the steam area. For this purpose, the limiting surface of the steam application chamber includes an acute angle of between 60° and 90° with the limiting surface of the air area. The resulting limiting edge is designed as sharp as possible. This results in a small deflection of the steam jet. In addition, it is achieved that substantially that air is sucked from the steam jets which previously had already been forced to flow back at the web surface by the impinging steam jets. This results in an air vortex whose temperature is significantly increased because of its repeated contact with steam. A trough-shaped configuration of the steam blower box contour in the area of this front sealing zone in web direction in front of the steam chamber can further support this vortex formation.

In accordance with the invention, a temperature sensor is placed into this air vortex for controlling the steam quantity and speed; this creates a criterion with respect to whether the desired locking effect at the web entry side has been achieved. As long as the impingement pressure on the steam side is smaller than the back-up pressure on the air side, fresh air continuously flows to the measuring location and no significant temperature increase can be detected. On the other hand, a significant temperature increase near the level of the steam temperature at the measuring location signals that the air has been successfully locked relative to the steam chamber. It is possible to arrange a second temperature sensor in the gap between the steam blower box and the material web in the vicinity of the front limitation of the steam blower box (front edge). At this location, the air locked at the border of the steam application area flows back out. In the case of optimum adjustments, only a small heating of this air should occur.

As the speed of the material web increases, it becomes more difficult to carry out the above-described adjustment by means of the two measured temperatures because the steam excess required for the desired pressure build-up at the web increases and, thus, the two measured temperatures could be close together. Consequently, in accordance with the invention, a suction duct can be arranged between the temperature measuring locations, wherein advantageously a further temperature measuring location may be mounted in this suction duct. Using such a suction duct, the adjustment can be carried out in accordance with the invention as follows in a very sensitive manner:

First, the steam flow from the steam outlet openings of the first group is increased without suction until a significant temperature increase occurs at the first measuring point in the air vortex. Subsequently, the suction effect is increased until no temperature increase relative to the surrounding area is detectable anymore at the measuring point at the front limitation of the steam blower box, so that no steam emerges from the steam blower box. If this causes the temperature at the measuring point in the air vortex to drop, the steam quantity can be increased accordingly. The measuring point in the suction duct serves to control both adjustments and permits an evaluation of the efficiency because the heating of the withdrawn air quantity is to be considered a lost output.

The same considerations with respect to the web entry side are applicable to the end of the steam chamber on the web exit side with respect to the injector effect of the steam jets.

At the rear end of the steam chamber, the heat absorption capacity of the material web is essentially zero. The steam from the steam outlet openings of the second group flows into the interior of the steam application area if there is still a negative pressure present in dependence on the heat absorption capacity of the web. The injector effect which also occurs at the limiting edge of the steam chamber on the side of the web exit makes it possible to have the air flowing in against the web movement from the rear side into the steam application area, if there is no excess pressure in the steam area when the steam jets impinge upon the material web, as is the case at the entry side of the web.

As a result of a sufficient steam excess from the steam outlet openings of the second group in front of the rear limiting surface, a flow is created which prevents air from penetrating into the steam chamber. However, heated and moistened air will always flow in the vicinity of the web in the travel direction of the material web. Therefore, a simple temperature measurement as on the side of the web entry does not make it possible to differentiate between a rear flow of air into the steam chamber and a successful locking. By measuring the steam application effect itself, i.e., by the measurement of the web temperature after the steam application or the properties influenced by the steam application, such as smoothness in the case of steam application by a calender, is only possible to determine the limit up to which an increase of the outflowing steam quantities from the openings of the second group still result in an appropriate effect. Such a measurement can also be carried out in accordance with the present invention and can be integrated into the control.

The configuration of the limiting edge between the steam application area and the air area on the side of the web exit corresponds to that on the side of the web entry and includes an acute angle, an edge which is as sharp as possible, and a trough-shaped configuration of the sealing zone which follows in the web direction.

However, the generation of a vortex, at which air is sucked in which has again and again come into contact with the steam as much as possible and, therefore, has been heated, is only possible if a free discharge of the air is not possible after the steam blower box in the web direction because, for example, the web is guided through a nip between two rolls, or if, in accordance with the invention, a further suction means is provided. Without such a suction means (or a limitation of the flow by the nip), the pressure at the web surface drops from the back-up pressure produced by the impinging steam jets from the steam outlet openings of the second group in the web direction to zero. Accordingly, the air which has come into contact with the steam flows off with the web without impediment and fresh air flows continuously against the web movement into the gap of the sealing zone. In the trough according to the present invention, an air vortex is formed because of the pressure drop caused by the increase of the width of the gap, however, this air vortex has a direction which is opposite that of the air vortex on the side of the web entry. As a result, fresh air is supplied continuously to this air vortex at the limitation remote from the web and, on the other hand, this vortex continuously discharges overheated air in the vicinity of the web. In contrast, a suction means between the steam chamber and the rear limitation of the steam blower box causes a negative pressure to which air flows from both sides. This makes it possible to increase the force of the air vortex, so that a major portion of the air which has come into contact with the steam and has thus been heated is placed in a circular motion. Depending on the available space for construction, the distance between the end of the steam chamber and the suction means, i.e., the space for the second air vortex on the side of the web exit, should be kept as large as possible. In the area of this air vortex on the side of the web exit and in the suction duct, according to the invention a temperature measuring location each can be provided. Both measuring locations serve to control the suction effect at the web exit side.

While a temperature as high as possible is desired at the measuring locations in the air vortex by increasing the suction effect, a heating relative to fresh air which is as small as possible is supposed to be detected at the measuring point in the suction duct. A strongly heated air at the suction duct indicates that steam has been withdrawn from the steam chamber, i.e., the suction effect would have to be lowered. The aforementioned measuring possibilities, which in dependence on the dimensions of the material web transversely of the direction of movement may advantageously provide it several times, the separation according to the present invention between an essentially air-free steam area and the adjacent air area can be controlled well. Furthermore, the heated air which has been suctioned off at the suction ducts in the front and rear sealing zones, can be blown against the material web possibly after dehydration at the end of the steam blower box on the side of the web exit. This makes it possible to achieve a further reduction of the air quantity discharged in the vicinity of the web and the formation of the air vortex on the side of the web exit is reinforced.

The optimized steam application described above provides the result that the web is heated over its entire width to almost 100° C. and is enriched with moisture accordingly. If a different steam application is to be achieved transversely of the travel direction of the web, the present invention provides that the applied steam quantities are reduced zones having lower desired steam application rates preferably at the steam outlet openings of the first group as compared to the basic adjustment. This causes the back-up pressure at the web to be lowered at the limiting edge of the steam chamber on the side of the web entry, so that air can flow in at that location partially and in a targeted manner. The resulting local reduction of the steam application efficiency makes it possible to carry out a very fine profiling of the steam application transversely of the material web.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1A:
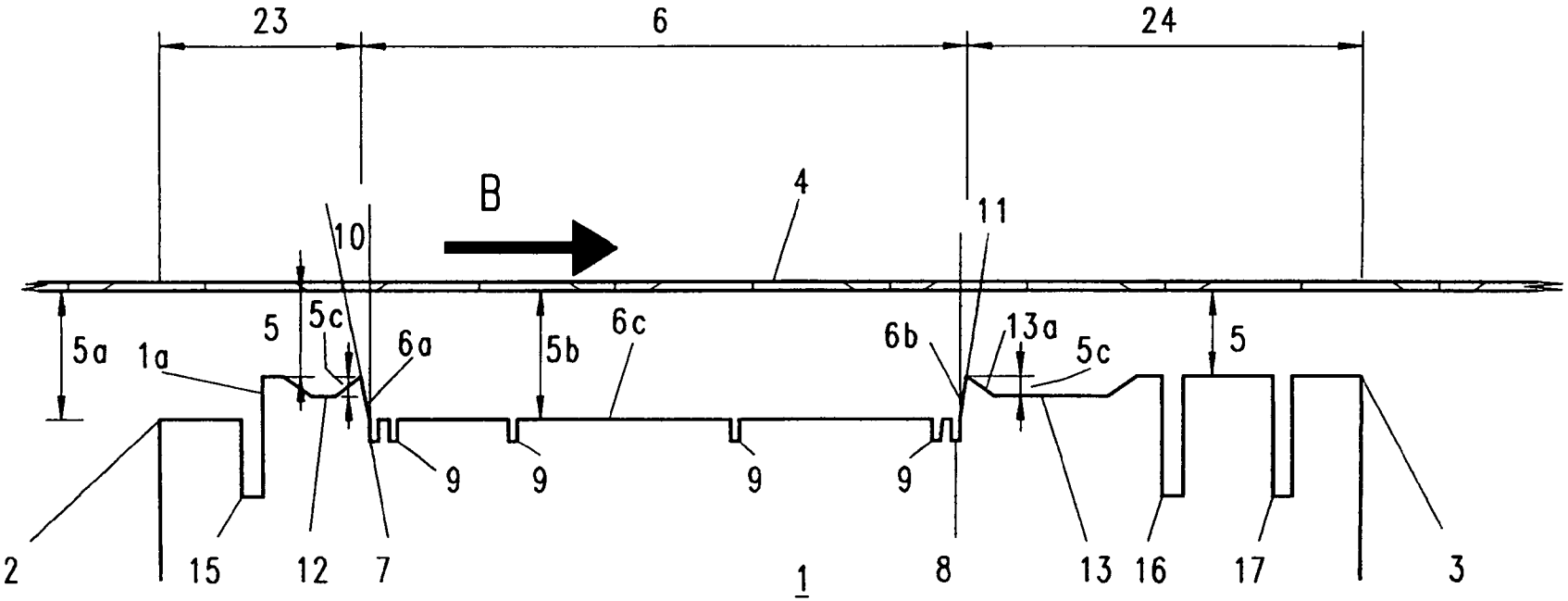
FIG. 1*a* is a schematic view of a steam blower box according to the present invention.

The steam blower box 1 illustrated in a sectional view in FIG. 1 is arranged at a distance from a paper or material web 4 formed by a minimum gap 5, wherein the material web 4 travels past the steam blower box 1 in a travel direction B indicated by an arrow. The steam blower box 1 is defined by a front limitation 2 located forwardly in the direction of movement B of the material web 4 and a rear limitation 3 arranged rearwardly in the travel direction B of the material web 4, wherein a steam chamber 6 which is open toward the material web is located between the limitations 2 and 3; in the following, the steam chamber 6 will also be called the steam application area.

The steam application area 6 only takes up a portion of the distance between the limitations 2, 3 of the steam blower box 1. In front of and following the steam application area 6, a corresponding front sealing zone 23 and a rear sealing zone 24 are formed, wherein these sealing zones extend up to the limitations 2, 3 of the steam blower box 1. The actual steam application area 6 is formed in the direction of travel B of the material web 4 by front and rear limiting surfaces 6*a*, 6*b* and transversely of the direction of movement B by appropriate surfaces, not shown, which extend close to the material web 4 with the exception of the minimum gap 5 (gap width), as is the case with the limiting surfaces 6*a*, 6*b*. The housing wall 6*c* of the steam application area 6 between the limiting surfaces 6*a*, 6*b* is recessed from the material web 4 relative to the surfaces 6*a*, 6*b*, so that the distance 5*b* from the housing wall 6*c* of the steam blower box 1 to the material web 4 is greater than in the minimum gap 5. The distance 5*b* may be greater than the gap width of the minimum gap 5 by about 5-40 mm preferably about 20 mm.

Steam outlet openings 7, 8, 9 are arranged in the housing wall 6*c* of the steam blower box 1 within the steam application area 6. The steam outlet openings 7, 8, 9 can be constructed as slots or rows of bores arranged transversely of the direction of movement B of the material web 4. The steam outlet openings 7, 8, 9 are controlled in groups, i.e., they are each connected to separate steam chambers, not shown, through which the steam quantity and/or the steam outlet speed can be set.

The first group of steam outlet openings 7 is located immediately following the front limiting surface 6*a* on the side of the web entry. The steam outlet openings 7 are preferably divided into various zones transversely of the direction of movement B of the material web 4 and are connected to corresponding separate steam chambers. Consequently, they can be controlled in zones.

The second group of steam outlet openings 8 are constructed so as to correspond to the first group of steam outlet openings 7 and are arranged as closely as possible in front of the limiting surface 6*b* of the steam application area 6 on the side of the web exit. Deviating from the example illustrated in FIG. 1, both groups of steam outlet openings 7, 8 can also be composed of several openings, slots or rows of bores which should however be placed in immediate vicinity to each other.

A third group of steam outlet openings 9 is provided particularly for cases in which the material web has a high steam absorption capacity; in the illustrated embodiment, the steam outlet openings 9 are composed of several slots of rows of bores. These openings are not arranged immediately next to one another, but are distributed approximately corresponding to the heat absorption capacity of the material web 4 to be expected in the direction of movement B. The steam outlet openings 8, 9 can also optionally be controlled in zones transversely of the direction of movement of the material web 4.

In order to provide the steam jets emerging from the steam outlet opening 7 of the first group with a directional component against the direction of movement B of the material web 4, the limiting surface 6*a* on the side of the web entry is inclined away from the steam application area 6 by an angle 10 relative to the perpendicular of the material web 4. The size of the angle 10 depends on the speed of the material web 4, on the one hand, and, on the other hand, on the width of the minimum gap 5, and may have values of between 0° and 30°, preferably 10°. Accordingly, the angle between the housing wall 6*c* and the limiting surface 6*a* is between 90° and 120°, preferably 100°.

The limiting surface 6*b* of the steam application area 6 is in an analogous manner inclined outwardly by an angle 11 from the perpendicular direction to the material web 4, in order to provide the steam jets emerging from the steam outlet openings 8 of the second group with a directional component in the direction of movement B of the material web 4 and, thus, to counteract the air which flows in from the limitation 3 of the steam blower box 1 on the side of the web exit. The size of the angle 11 depends on the ratio of the totally applied steam quantity relative to the steam quantity emerging from the steam outlet openings 8 of the second group, and the width of the gap 5 and the speed of the material web 4. The size of the angle 11 may be about between 0° and 20 to 30°, preferably 5°.

Figure 2A:
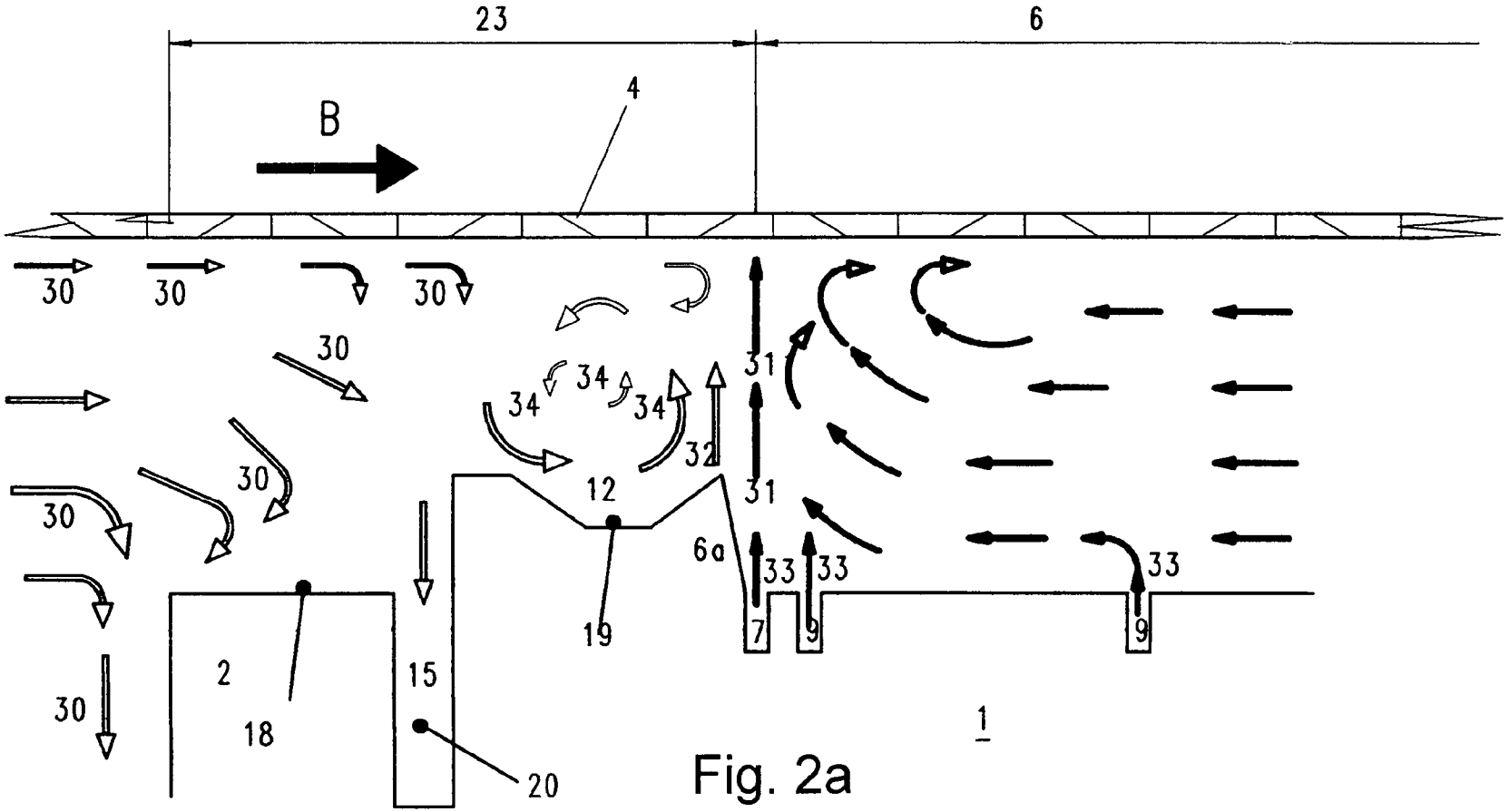
FIG. 2*a* is a schematic illustration showing the flow pattern in the gap between a steam blower box according to FIG. 1*a* and the material web at the end on the side of the web entry.
Figure 2B:
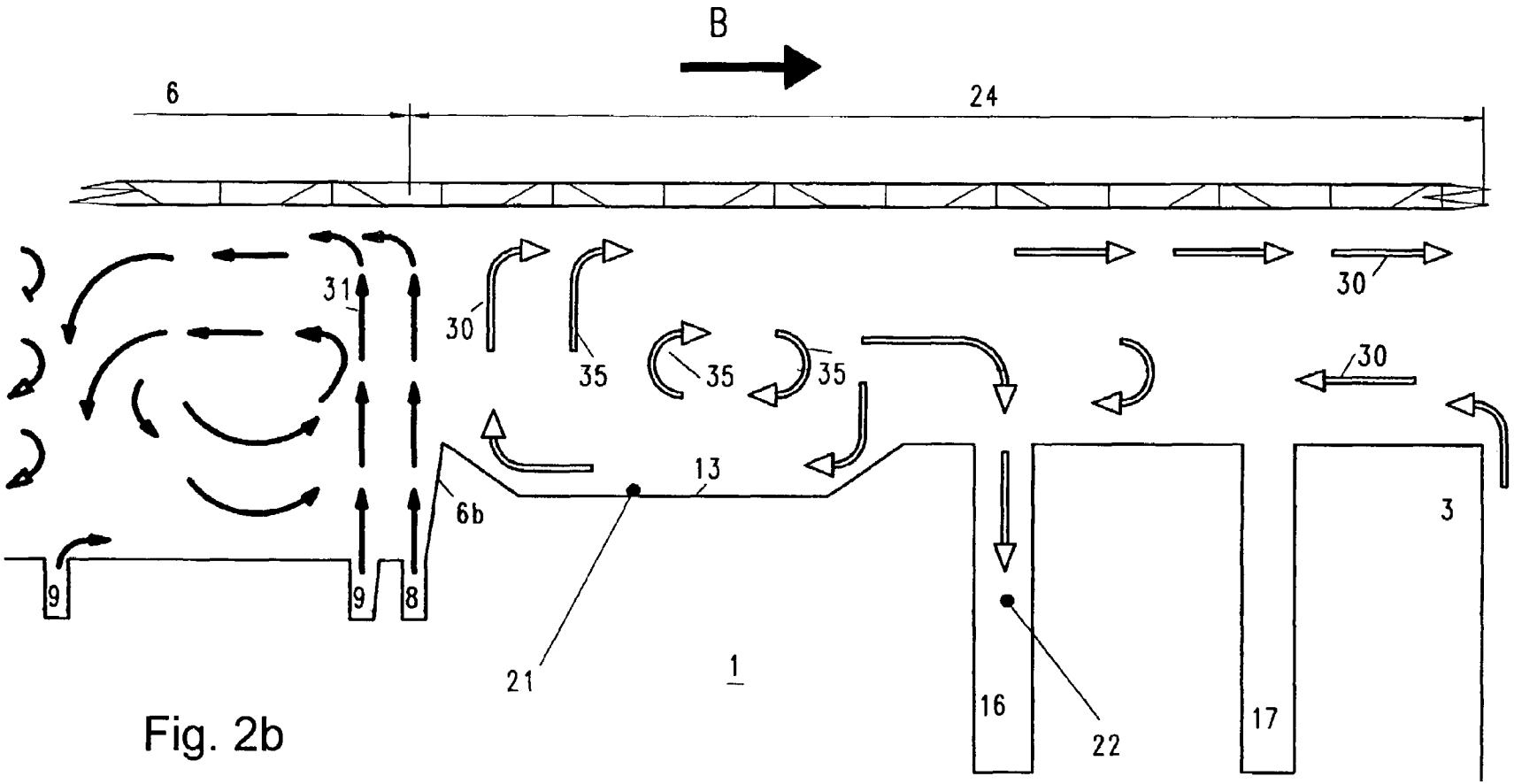
FIG. 2*b* is a schematic illustration showing the flow pattern in the gap between a steam blower box according to FIG. 1*a* and the material web at the end on the side of the web exit.

The front sealing zone 23 formed between the front limitation 2 of the steam blower box 1 and the front limiting surface 6*a* of the steam application area 6 and the rear sealing zone 24 formed between the rear limiting surface 6*b* of the steam application area 6 and the rear limitation 3 of the steam blower box 1 serve as sealing means against the penetration of air into the steam application area 6 and against the discharge of heated and oversaturated air into the surroundings of the steam blower box 1. As illustrated in FIGS. 2*a* and 2*b*, temperature sensors 18 to 22 are arranged in these areas. The temperature sensors serve for obtaining the necessary findings for controlling the individual components of the steam blower box. This control will be described in more detail below.

Troughs 12, 13 are arranged in and against the direction of movement B immediately following the steam application area 6 in the sealing zones 23, 24, wherein the troughs are formed in the housing wall of the steam blower box 1 facing the material web 4. This means that from the limiting surfaces 6*a* and 6*b* of the steam application area 6 with the minimum gap width 5 the distance of the material web 4 initially increases in order to then once again decrease toward the permissible minimum value of the gap 5. The gap 5*c* of the troughs 12, 13 is about a fourth to an eighth of the width of the gap 5. The length of the troughs corresponds in the direction of movement B of the material web 4 on the side of the web entry about the width of the gap 5, while on the web exit side the trough 13 can be constructed as long as possible depending on the available space. During operation, air vortices 34, 35 are formed within the troughs 12, 13. Advantageously, the distance between the front limitation 2 of the steam blower box 1 and the limiting surface 6*a* of the steam application area 6 is kept as small as possible, while the corresponding distance between the limiting surface 6*b* and the rear limitation 3 of the steam blower box 1 should be constructed as large as possible.

Figure 1B:
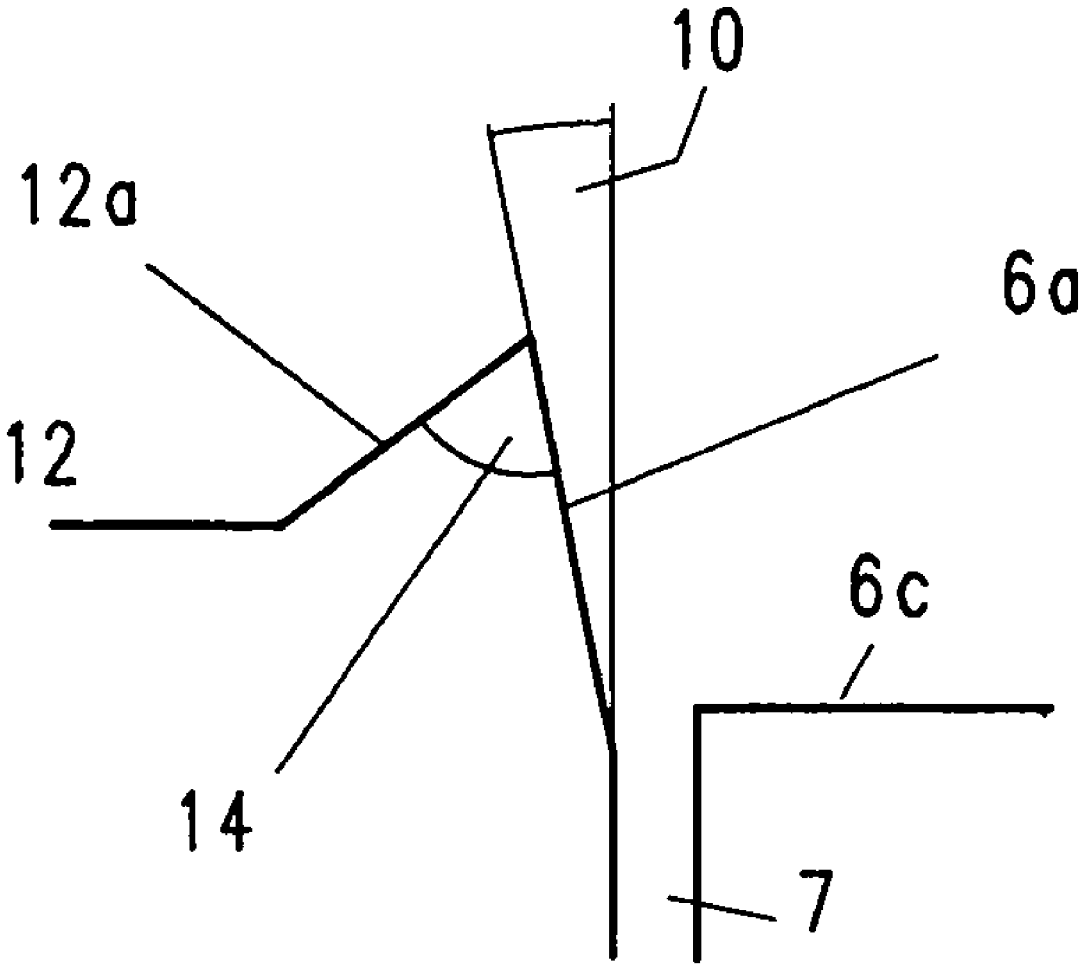
FIG. 1*b* is a detail of the steam blower box according to FIG. 1*a*, on a larger scale, showing a limiting edge of the steam chamber.

The shape of the troughs 12, 13 can be selected in accordance with the available manufacturing possibilities; however, the limiting surfaces 6*a*, 6*b* of the steam application area 6 should include an acute angle 14 between 60° and 90°, preferably 75° with the adjacent limiting surfaces 12*a*, 13*a* of the troughs 12, 13, and the resulting edge should be as sharp as possible. Consequently, the limiting surfaces 6*a*, 6*b* essentially form the limiting edges of the steam application area 6. FIG. 1*b* illustrates this configuration as an example for the trough 12 on the side of the web entry.

As seen in the direction of movement B in front of the trough 12, the steam blower box contour has in the front sealing zone 23 a greater distance 5*a* from the material web 4 than in the area of the limiting surface 6*a*. This distance corresponds preferably to the distance 5*b* between the housing wall 6*c* in the steam application area 6 and the material web 4. The steam blower box contour extends at the transition from the greater distance 5*b* to the minimum gap 5 approximately perpendicularly of the material web 4. This surface 1*a* arranged perpendicularly relative to the material web 4 has the purpose of already partially holding up the air flow which is entrained with the web and, thus, to reduce the back-up pressure at the border between the air area and the sealing zone 23 and the steam area in the steam application area 6. This is reinforced by a suction duct 15 arranged in front of this surface 1*a*, wherein the suction duct 15 makes it possible to further lower the back-up pressure and to safely prevent air which has come into contact with steam from emerging from the steam blower box 1.

On the side of the web exit, the limitation 3 of the steam blower box 1 has a distance to the material web which is in the order of magnitude of the minimum gap 5. By using the permissible minimum distance of the gap 5, the air exchange due to outflow in the vicinity of the material web 4 and inflow in the vicinity of the wall of the steam blower box 1 facing the material web 4 are to be minimized.

A suction duct 16 is provided between the trough 13 and the rear limitation 3 of the steam blower box 1. By providing for the withdrawal of air at this location, the formation of an air vortex 35 on the side of the web exit in the area of the trough 13 is reinforced because air which has already come into contact with steam is in an essentially circular motion. This will be explained in more detail with the aid of FIGS. 2*a* and 2*b*. Moreover, an air entry opening 17 is provided between the suction duct 16 and the rear limitation 3, wherein any air suctioned off in the suction ducts 15 and/or 16 is again partially blown out. However, this air entry opening 17 is optional and is not absolutely necessary for the operation of the steam blower box 1 according to the present invention.

FIGS. 2*a* and 2*b* show the flow conditions in the area of a steam blower box 1 according to the present invention. FIG. 2*a* shows the front portion of the steam blower box 1 on the side of web entry which includes the front limitation 2, the adjacent front sealing zone 23 with the suction duct 15 on the side of the web entry and the front trough 12, as well as the beginning of the steam application area 6 in the steam chamber with the steam outlet openings 7 and 9. FIG. 2*b* supplements the end of the steam blower box 1 on the side of the web exit with the end of the steam application area 6 in the steam chamber, the outlet openings 8 and 9 arranged in the steam chamber, and the rear sealing zone 24 with the trough 13 the suction duct 16 on the side of the web exit, the air entry openings 17, which are not illustrated in operation in the flow chart of FIG. 2*b*, until reaching the rear limitation 3 of the steam blower box 1. In addition, FIGS. 2*a* and 2*b* show the temperature sensors 18, 19, 20, 21, and 22 at their appropriate mounting positions on the front limitation 2, in the front trough 12, in the suction duct 15, in the rear trough 13 and the suction duct 16.

An air flow 30 which is moved along with the material web 4 because of friction at the web surface and which is illustrated by a double arrow is introduced partially into the gap 5*a* of the front sealing zone 23 between steam box blower contour and material web 4 and is backed up partially at the front limitation 2 of the steam blower box and is deflected by the limitation 2. The air flow 30 impinges in the area of the limiting edge 6*a* on a steam jet 31 which emerges with high speed from the first group of steam outlet openings 7, wherein the steam jet 31 is illustrated by simple arrows. At the front end of the limiting surface 6*a* of the steam chamber 6, where the steam first impinges upon the air flow 30, the injector effect produces a negative pressure area 32 and the air flow is deflected together with the steam in the direction of the material web 4. Depending on the inclination of the limiting surface 6*a* of the steam application area 6, this flow can be easily directed against the direction of movement B of the material web.

The portion of the air flow 30 which travels with the material web 4 and the steam jet 31 together with the withdrawn part of the air flow 30 impinge upon each other and a back-up pressure is generated. As soon as the back-up pressure in the steam area becomes greater than in the air area at the border between steam and air in spite of a volume loss of the steam due to condensation at this location at the material web 4 which is still essentially cold, the air flow 30 is completely forced to turn around, as illustrated in FIG. 2*a*. Because of the above-described injector effect in the negative pressure area 32, a portion of the air flow 30 is once again sucked in by the steam jet 31. This results in an air vortex 34 on the side of the web entry, wherein air which has already come into contact with steam and, therefore, is preheated, is in a circular motion.

In front of the air vortex 34 as seen in the direction of movement B, the deflected air flow 30 must be pressed once again past the front limitation 2 from the gap 5 between the front limitation 2 and the material web 4. For this purpose, the back-up pressure produced at the border between sealing zone 23 and steam application area 6 must be sufficiently high. In order to keep the steam excess, which is required for this pressure build-up, within reasonable limits, a back-up pressure which is as low as possible is desired at the front limitation 2 of the steam blower box 1. The largest distance 5*b* to the material web 4 is provided for this low back-up pressure in comparison to the width of the minimum gap 5 in the area of the limiting surface 6*a*. Another possibility for adjusting the back-up pressure to a level which is as low as possible is provided by the suction duct 15 which makes it possible to withdraw the entire air flow 30 or a portion thereof. A control for a successful locking of the air flow 30 from the steam application area 6 is provided by a temperature sensor 19 mounted in the front trough 12 and the temperature sensor 18 mounted in the vicinity of the front limitation 2 of the steam blower box 1. If the impingement pressure of the steam jet 31 is not sufficient for stopping the air flow 30, fresh air which has not yet been heated is continuously conducted to the sensor 19 where a significant temperature increase cannot be found. On the other hand, if the locking of the air flow 13 has been successful, the air vortex 34 forms and a significant temperature increase can be measured at the temperature sensor 19. If too much steam is discharged through the steam outlet openings 7, the entire air flow 30 is heated, so that the temperature sensor 18 also indicates a significant temperature increase. The flow pattern in the area of the temperature sensor 18 can be influenced by the suction duct 15. While the entire back flow of the air flow 30 travels outwardly at and past the temperature sensor 18 when the suction effect is turned off, a portion or the entire back flow can be suctioned off in dependence on the suctioning power of the suction duct 15. In this situation, no heated or moistened air is discharged at the side of the steam blower box 1 on the side of the web entry. The temperature sensor 18 does not indicate a temperature increase.

In order to prevent unnecessary steam quantities from being suctioned off by an excess suctioning power, the suctioning power is decreased in accordance with the method according to the preset invention. By arranging the steam outlet openings 7 in the immediate vicinity of the limiting surface 6*a* of the steam application area 6 and at a greater distance 5*b* from the material web 4 than the edge of the limiting surface 6*a* near the web, it is prevented that the air flow 30 flows from the area of the steam blower box into a negative pressure area 33 formed in the steam application area 6 in the vicinity of the steam outlet openings 7 by the steam jet 31. Rather, the negative pressure prevailing in this area suctions steam from the steam application area 6, wherein the steam is applied through the steam outlet openings 9 of the third group and/or the steam outlet openings 8 of the second group into the steam application area 6. As a result of the above-described manner of operation of the front sealing zone 23, the steam application area 6 is completely filled with steam as long as air does not flow in from the end of the steam blower box 1 on the side of the web exit.

This situation may occur if insufficient steam emerges from the steam outlet openings 8 of the second group and possibly from the steam outlet openings 9 of the third group. Although the material web 4 no longer absorbs any or almost no heat at the rear limiting surface 6*b* of the steam application area 6, the impingement pressure at the material web 4 required for locking out the air cannot be built up in this case because the steam jets 31 are deflected because of the negative pressure within the steam chamber. Therefore, the air flow 30 which flows in from the end of the steam blower box 1 on the side of the web exit partially flows in to the steam application area 6 and, thus, decreases the efficiency of the heat transfer. By increasing the steam quantity applied through the steam outlet openings 8, the flow pattern then changes over into the flow pattern according to the present invention, as shown in FIGS. 2*a* and 2*b*.

It is not easily possible to distinguish the two above-described conditions by means of temperature sensors because in both cases colder air flows at the temperature sensor 21 into the trough 13 bn the side of the web exit in the direction of the steam application area 6 and, after steam contact and the corresponding heating and moisture increase, flows back again in the immediate vicinity of the material web 4. The adjustment of the steam jet 31 from the steam outlet openings 8 is therefore carried out by evaluating the steam application effect on the material web 4. The criteria used are, for example, temperature, moisture, smoothness, etc.

Using the suctioning effect in the suction duct 16 and optionally an additional air flow into the air entry openings 17, the largest part of the heated and moistened air is prevented from flowing into the surroundings of the steam blower box 1. The efficiency of this locking effect can be evaluated by means of the temperature sensors 21 in the trough 13 and the temperature sensor 22 in the suction duct 16. Desired as the optimum condition is a temperature at the temperature sensor 21 in the trough 13 which is as high as possible, so that the formation of the air vortex 35 on the side of the web exit according to the invention is indicated, and a temperature at the temperature sensor 22 which is as low as possible is desired because excess steam is not unnecessarily suctioned out of the steam application area 6.

Figure 3:
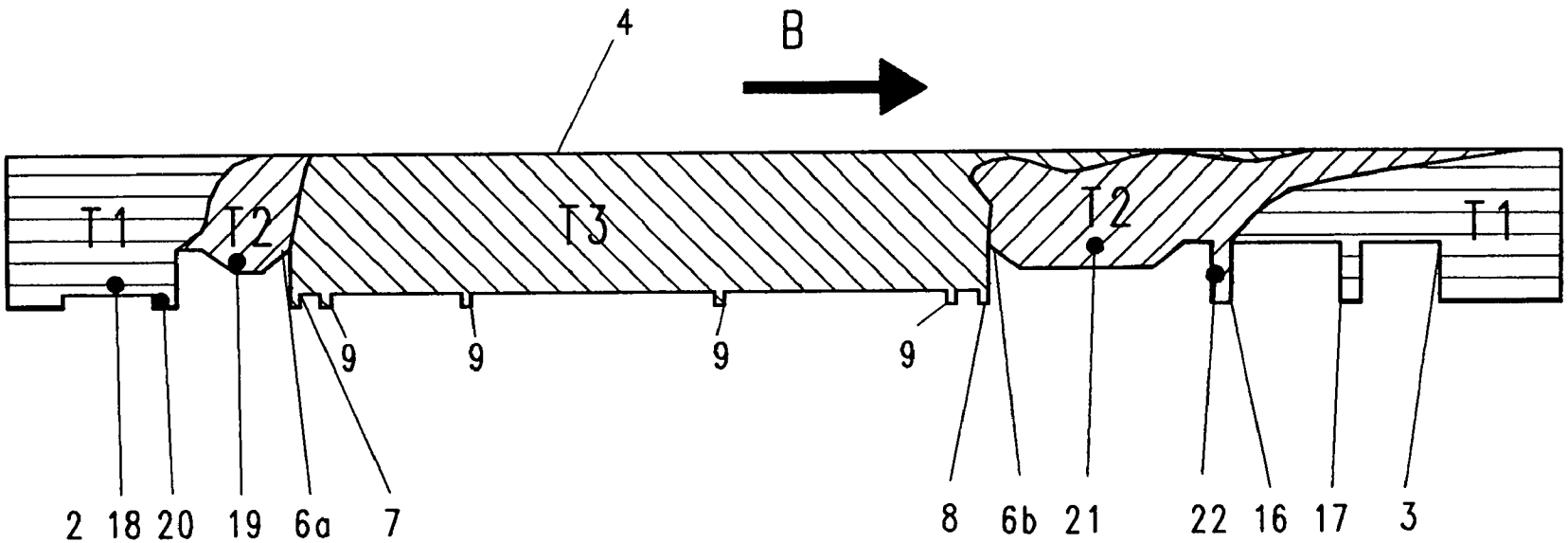
FIG. 3 is a schematic illustration of the temperature distribution in the gap between a steam blower box according to FIG. 1*a* and the material web and the arrangement of the temperature sensors.

All temperature sensor 18, 19, 20, 21, 22 can also be arranged several times over the width of the material web 4, for example, one each in each controllable zone. The considerations with respect to the temperature measurements can be carried out with the aid of FIG. 3. The temperature zones T1 represent the air portions which are not or almost not influenced by the steam of the steam blower box 1, while, according to the invention, steam temperature of about 100° C. prevails in the temperature zone T3. The transition areas T2 located between the areas T1 and T3 contain air which has come into contact with steam and therefore is more or less heated, wherein the temperature pattern depends on the respective flow conditions whose state can therefore be evaluated indirectly in the above-described manner.

Figure 4:
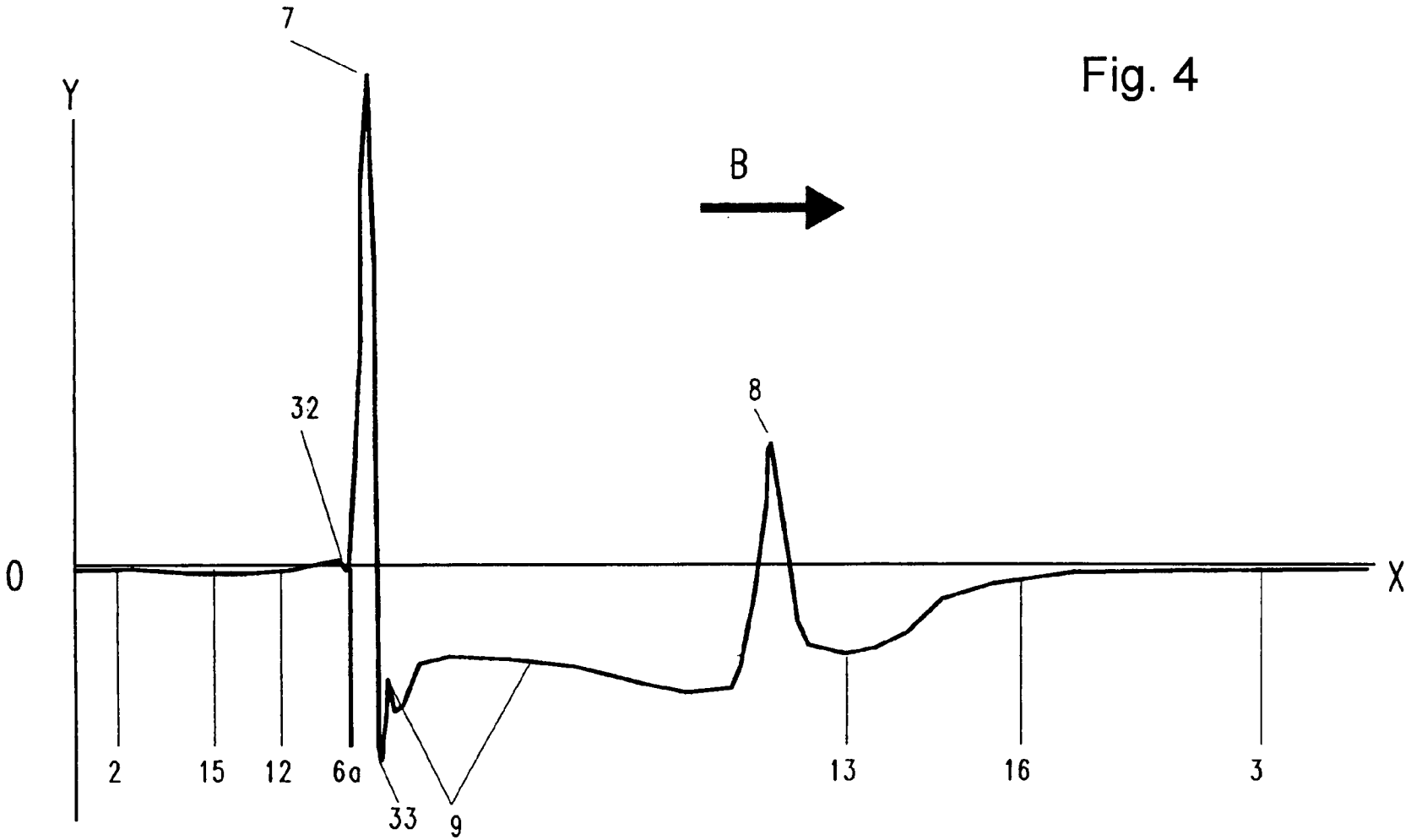
FIG. 4 is a schematic illustration of the pressure pattern at the material web during steam application with the steam blower box according to FIG. 1*a;*
Figure 5B:
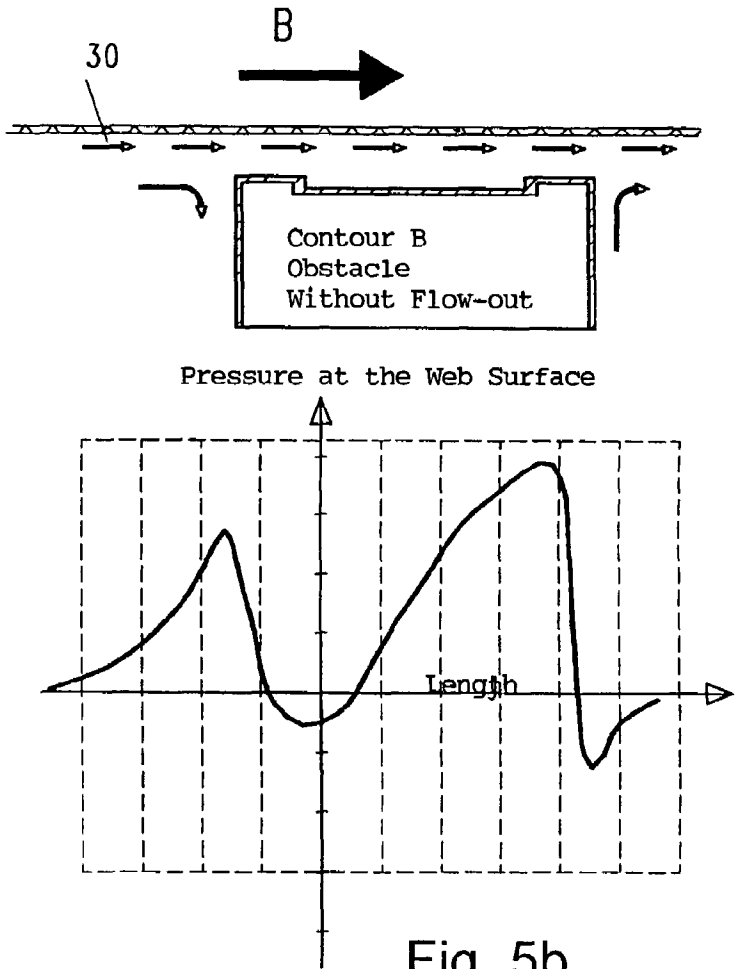
FIGS. 5*a* and 5*b* show schematically the pressure development at the moved material web at obstacles near the web for the entrained air flow in dependence on the shape of the obstacle.
Figure 5A:
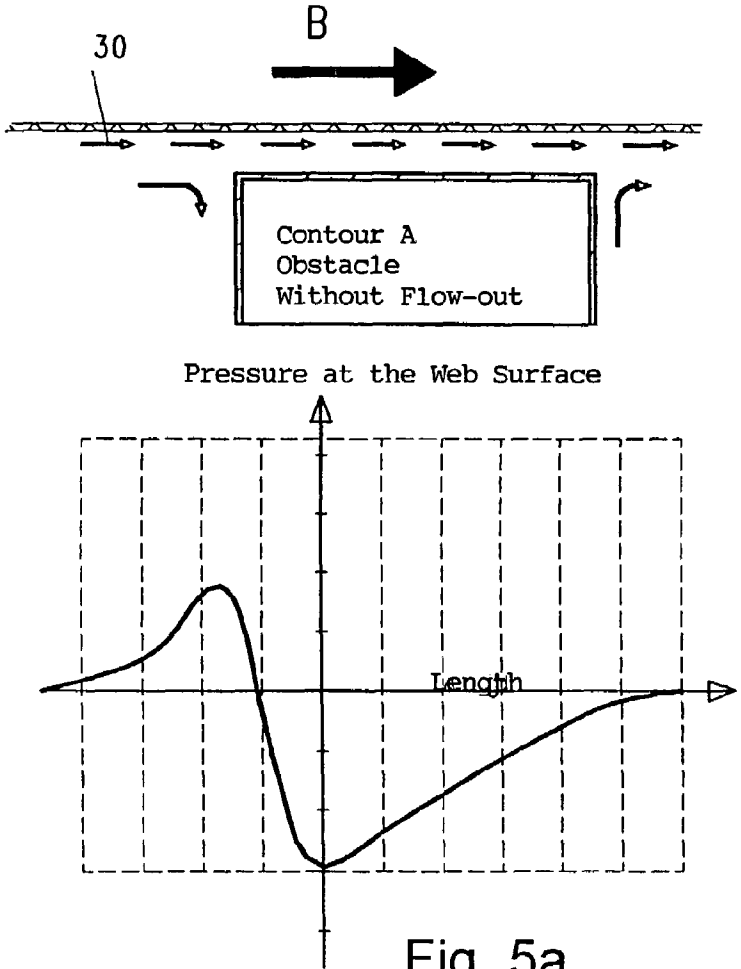

FIG. 4 schematically shows the pressure pattern at the surface of the material web 4 in the area of the steam blower box 1, wherein the indicated reference numerals show the respective position in the direction of movement B of the material web along the X-axis. The pressure values plotted on the Y-axis depend in each individual case on the discharged quantity and discharge speed of the steam from the respective steam outlet openings 7, 8, 9 of the steam blower box 1, on the one hand, and, on the other hand, on the volume loss caused by the steam condensation due to heat transfer, the speed of the material web 4, the suction ducts 15, 16 and the air inlet opening 17, as well as possibly flow obstacles near the web in front of and/or behind the steam blower box, for example, rolls. Because of the large number of influences, no scale has been used on the Y-axis. The pressure values at the material web 4 normally are in the range of +/−a few 100 Pa.

FIG. 4 shows on the X-axis the corresponding positions of the steam blower box 1 according to the present invention. At a sufficiently large distance from the steam blower box, the pressure value at the material web 4 is zero, which is where the curve in FIG. 4 begins and ends.

The pressure rises already in front of the limitation 2 because the air flow entrained by the material web 4 cannot unimpededly enter into the gap between the material web 4 and the steam blower box 1. However, this is not illustrated in FIG. 4 because only the back-up pressure in the vicinity of the web is illustrated, wherein this pressure is not yet generated at this location in the vicinity of the material web 4. The suction duct 15 and/or an increase in the width of the gap as a result of the trough 12 according to the present invention, a pressure drop occurs which, together with the suctioning effect, may even assume a negative value. A pressure peak at the surface of the material web 4 is developed at the border to the steam application area 6 by the steam jet 31 impinging upon the material web 4, wherein the pressure peak is sufficient for completely locking out the air flow 30 and to deflect the air flow in the direction of the limitation 2 or the suction duct 15. This takes place in the area of the front limiting surface 6*a* and the first steam outlet opening 7. As can be seen in FIG. 4, the pressure once again steeply drops to the right of this pressure peak; usually the pressure drops to negative values. The reason for this is the high heat transfer from the steam to the material web at this location. On the one hand, the material web 4 is still the coldest at this location because the steam application has only just begun. On the other hand, air does not have access to this negative pressure area 33. This means that the heat transfer is at an optimum high. Accordingly, a high condensation rate of the steam when the material web 4 enters into the steam application area 6 explains the steep pressure drop. Depending on arrangement and control of the openings 8, 9 steam flows from there into the negative pressure area and the continuously dropping condensation rate in the direction of movement B of the material web 4 results approximately in the pressure pattern illustrated in FIG. 4. It can be seen that, for avoiding excessive negative pressure areas and, thus, unnecessary transverse flows and vortices, it may be advantageous to arrange the steam outlet openings 9 of the third group approximately in accordance with the heat absorption of the material web 4 to be expected.

However, directly in the area of the outlet openings 8, the pressure once again must once again be at a peak approximately in the same order of magnitude as at the beginning of the steam application area 6, in order to prevent a rearward airflow 30. This second pressure peak is achieved by an appropriate control of the steam outlet openings 8.

In the direction of movement B of the material web 4, behind the steam application area 6, a negative pressure is generated inevitably approximately in the area of the trough 13 and near the web because the material web 4 causes here to be conveyed outwardly because of friction wherein, however, no air can flow from the steam area 6. This negative pressure draws air into the gap between the material web 4 and the steam blower box 1 against the direction of movement B. The negative pressure can be increased by means of the suction duct 16. This has the result that the pressure at the rear limiting surface 6*b* at the steam chamber is also lowered. The pressure peak required at this location in the steam chamber becomes smaller, so that a smaller steam excess is required.

Starting from the analysis of the pressure distribution at the material web 4 in the area of the steam blower box 1 in accordance with FIG. 4 and the resulting flow distribution, it was possible to determine basic concepts for the construction and configuration of steam blower boxes and to propose a measuring method by means of which the necessary adjustment values of the flow can be controlled in order to ensure a steam application area which is as free as possible of air. Despite of the large number of different technological parameters in the steam application of material webs 4, such as web distance, web speed and web properties relevant for the heat absorption (web thickness, initial temperature, moisture content, specific heat capacity), it is therefore possible to always ensure an optimum heat transfer or moisture application by carrying out a targeted adjustment of the steam flows from at least two groups of outlet openings 7, 8, wherein optionally a third group of outlet openings 9 and controlled suction ducts 15, 16 are provided. Steam outlet openings 7, 8, 9, which are arranged in groups and are at least in part differently controllable in zones transversely of the material web, and, by arranging the steam outlet openings 7, 8, 9 at a greater distance 5*b* from the material web 4 than all limitations of the steam application area 6, the air is almost completely kept away from the material web 4 in the steam application area 6 and, thus, a high steam application efficiency is achieved. This optimum condition can be stabilized by suctions ducts 15, 16 and can be controlled and regulated by temperature sensors.

While specific embodiments of the invention have been shown and described in detail to illustrate the inventive principles, it will be understood that the invention may be embodied otherwise without departing from such principles.

I claim:

1. A method of controlling steam quantity and/or steam exit speed from steam outlet openings of a steam blower box for applying steam onto a material web travelling past the steam blower box, the method comprising forming an air vortex on a web entry side when sealing a steam application area relative to air, and increasing the steam quantity and/or steam outlet speed from a first steam outlet opening until an increased temperature is measured in an area of the air vortex until an increased temperature is measured in the area of the air vortex corresponding to the steam temperature.

2. The method according to claim 1, comprising measuring the temperature in the area of a front limitation, and adjusting the steam outlet quantity and/or steam outlet speed, such that the temperature in the area of the front limitation corresponds approximately to the temperature of ambient air.

3. The method according to claim 2, wherein air is suctioned off between the front limitation and the air vortex.

4. The method according to claim 3, comprising forming an air vortex when sealing the steam application area relative to air between a rear limitation of the steam blower box and the steam application area, suctioning air off between the air vortex and the rear limitation, wherein, by adjusting the suctioning power and/or the steam quantity and/or steam outlet speed from a second steam outlet opening, achieving in the air vortex a temperature which is a high as possible, and achieving in suction means a heating which is a small as possible relative to ambient air.

* * * * *